United States Patent [19]

Easton

[11] 4,014,406

[45] Mar. 29, 1977

[54] LADDER LEVELING DEVICE

[76] Inventor: James Fred Easton, 19 John St., Wellsville, N.Y. 14895

[22] Filed: May 13, 1976

[21] Appl. No.: 685,736

[52] U.S. Cl. ..... 182/204

[51] Int. Cl.[2] ..... E06C 7/44

[58] Field of Search ..... 182/204, 205, 201; 403/374, 409

[56] References Cited

UNITED STATES PATENTS

| | | | |
|---|---|---|---|
| 388,076 | 8/1888 | Schmidt | 182/205 |
| 810,170 | 1/1906 | Potter | 182/205 |
| 3,858,993 | 1/1975 | Lovisa | 403/374 |

FOREIGN PATENTS OR APPLICATIONS

| | | | |
|---|---|---|---|
| 901,224 | 7/1962 | United Kingdom | 182/205 |

*Primary Examiner*—Reinaldo P. Machado
*Attorney, Agent, or Firm*—Wayne H. Lang

[57] ABSTRACT

A ladder leveling device is disclosed by which one or both legs of the leveling device are adapted to be elongated to provide an upright and continuously stable position for the ladder on sloping or an irregular base.

1 Claim, 4 Drawing Figures

LADDER LEVELING DEVICE

BACKGROUND OF THE INVENTION

1. Field of the Invention

The present invention relates generally to an arrangement by which portable, free-standing ladders, tripods or other type supports that may be quickly positioned upon an irregular surface to provide an upright position having inherent stability.

2. Description of Prior Art

Devices that extend an upright side rail of a ladder or a tripod to permit said device to stand on uneven ground in a safe, upright position with a maximum of stability have at various times been developed. However, such devices are usually cumbersome, they have insufficient scope of adjustment, and most importantly, they are only slowly activated to obtain the proper results so that they find little use on fire fighting equipment and the like where rapidity of adjustment is extremely important.

Known devices are exemplified by U.S. Pat. No. 3,791,487 where each side beam of a ladder is provided with an extensible leg that may be moved lengthwise to provide the proper overall length. A manually operated knurled nut is turned to activate the locking mechanism by which each leg is supported in a predetermined position.

In U.S. Pat. No. 3,805,917 the legs of a ladder are mounted on the ends of a torsion bar having shoes that extend therefrom in opposite directions. While this adjusting means is readily actuated, it fails to provide maximum adjustment of one leg independent of the other.

Various other leg extension means have been developed, but they too invariably are complex, expensive and only laboriously activated. Most important, however, remains the fact that they are not rapidly adjusted to provide the proper length required for maximum stability.

SUMMARY OF THE INVENTION

The present invention is, therefore, directed to an arrangement that corrects the above noted undesirable characteristics of the previous art by providing an extension device that may be attached to one or more side rails of a ladder or the like to provide a rail having greater than than the original length. Moreover, it is simple in design, may be readily attached, is positive in action, and it may be rapidly adjusted to accommodate any degree of unevenness or irregularity on the ground.

The primary advantage of the present invention lies in the rapidity with which it may be adjusted to afford an upright setting, and thus it is particularly suited for application to ladders being used for fire fighting equipment or wherever a rapid elongation is required to provide a stable support.

The features of the present invention are set forth with great particularity in the accompanying specification and claims and illustrated by the accompanying drawings.

DESCRIPTION OF THE PREFERRED EMBODIMENT

Figure 1:
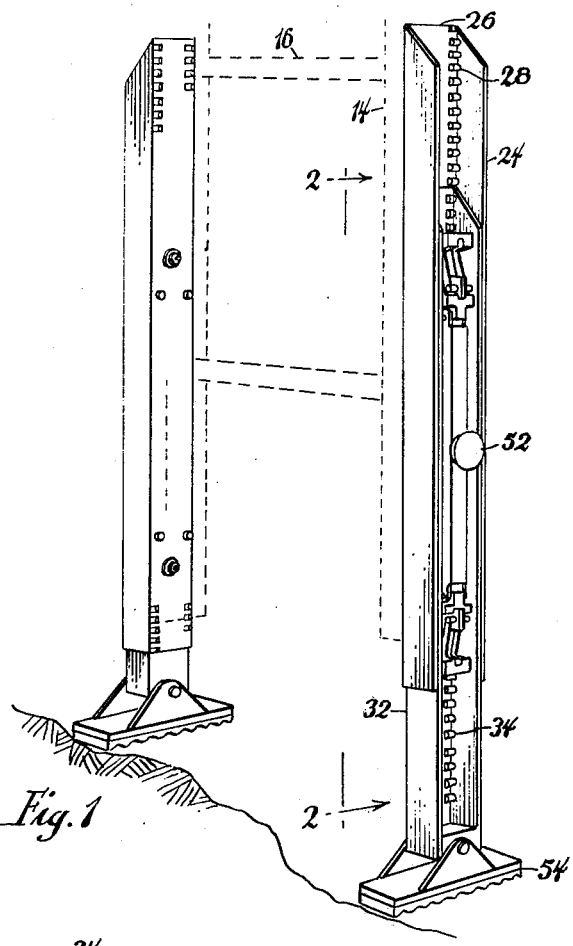
FIG. 1 is a perspective view of a ladder having a leveling means as defined herein.
Figure 2:
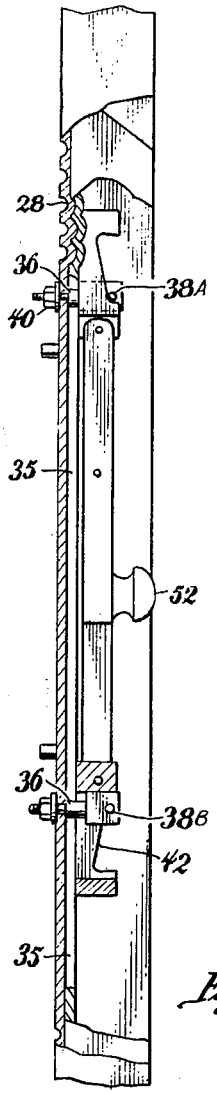
FIG. 2 is an enlarged side elevation of a single ladder adjusting means.
Figure 3:
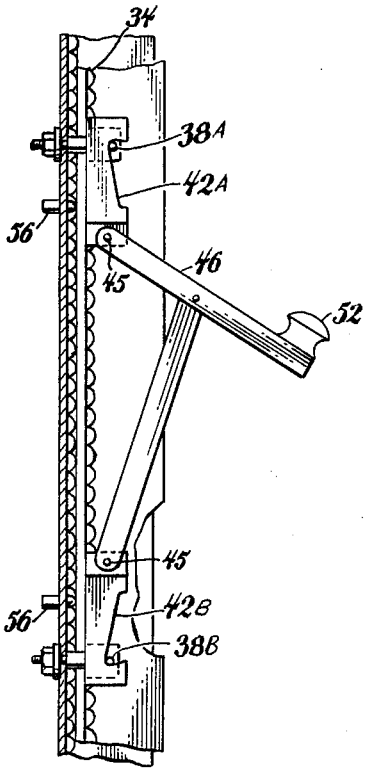
FIG. 3 is a side elevation of the adjusting means in an "open" position.
Figure 4:
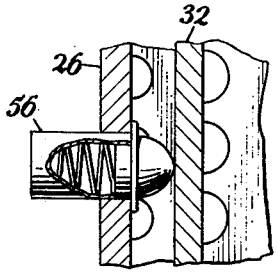
FIG. 4 is a view of a biasing means tending to hold the telescoping side rails of a leveling device in a free and independent position.

With reference now to the drawing, there is shown a conventional ladder having a pair of similar side rails 14 connected together with a series of equally spaced horizontal rungs 16. The ladder is adapted to be supported in an upright position only upon any firm, level surface.

In accordance with this invention, a conventional ladder as above defined may be adapted to be supported on any type of sloping ground or uneven terrain by the use of the leveling device as herein described.

The leveling device includes a pair of similar but independent telescoping legs attached symmetrically by any suitable means to the side rails of the ladder which normally contact the irregular surface of the ground.

Each telescoping leg comprises a first U-shaped channel member having side walls 24 that extend normal to an intermediate web 26. The web is formed to include a series of rack-like projections 28 that extend inwardly therefrom along the longitudinal extent of the channel.

A second U-shaped channel member 32 of somewhat lesser dimensions than the first channel is adapted to fit in the first channel and form a telescopic extension therefor. A longitudinal series of projections 34 in the web of the second channel is adapted to engage the projections in the web of the first channel member when they are pressed together. The second channel member 32 has an elongate slot 35 in the web thereof that slidably receives studs 36 extending inward from the web of the first channel to which they are secured by fastening devices 40. The length of the second channel member 32 and its elongate slot 35 is determined by the extent of elongation desired for each ladder side rail.

Each stud 36 includes a T shaped member 38 at the ends thereof that defines a fixed spacing between the "T" and the web of channel 32, while the stud 36 sliding in slot 35 permits longitudinal movement of the second channel within the first channel member, limited by the ends of the elongate slot.

Wedge means 42 is adapted to be moved between the "T" shaped cross member 38 and the web 26 of the first channel forcing channel members 26 and 32 tightly together whereby the projections 28 and 34 may be forced into engagement.

The wedge means includes a pair of oppositely inclined planes 42A and 42B, each slotted to receive stud members 36 that extend inwardly from longitudinally spaced locations along the web of the first channel member.

The members 42A and 42B are each pivotally attached at 45 to opposite ends of a compound lever actuator 46, said inclined planes each being moved oppositely when the knob 52 is depressed.

As the wedge means 42A and 42B are moved apart, the T shaped pin means 38A and 38B slide over the inclined surface of the wedge means to bring the channel members together and force the projections 34 of the second channel member to intermesh with the projections of the first channel member, thus locking the second channel member within the first channel member by a rapid depression of knob 52.

A pivotally attached shoe 54 is faced with corrugated rubber or the like to preclude slippage on most surfaces.

A spring loaded biasing means 56 is installed in the outer web 26 and is adapted to continuously bear upon the inner channel member 32 with a force sufficient to separate the inner channel member 32 from the outer member 26, when knob 52 or lever actuating mechanism 46 is raised.

Thus, as the knob 52 on lever mechanism 46 is raised to draw the wedge members 42A and 42B together and provide a clearance space under T bars 38A and 38B, the channels that comprise the side rails of the ladder are moved apart by means 56 to permit the projections 28 "slide by" projections 34 in order that one or the other legs of the ladder may be adjusted to the length desired.

While the rail extension device of the above invention has been disclosed with reference to the single embodiment of the drawing, it is evident that modifications may be made without departing from the spirit of the invention. It is, therefore, intended that all matter contained in the above description or shown in the accompanying drawing shall be interpreted as illustrative only and not in a limiting way.

I claim:

1. A ladder leveling device for extending a leg of a ladder having elongate side legs joined by spaced cross pieces, said leveling device comprising a first U-shaped channel member having side walls normal to an elongate web mounted on one of said legs, a longitudinal series of projections integral with said channel and extending inward from the web thereof, a second U-shaped channel member sized to fit in the first channel member and form a telescopic extension therefor, a longitudinal series of projections integral with the second channel member extending outward from the web thereof into intermeshing relationship with the projections of the first channel member, an elongate slot extending longitudinally through the web of the second channel member adjacent the projections thereon, means for drawing the web of the first channel member adjacent the web of the second channel member comprising at least two spaced projections affixed to the web of the first channel member to extend through the slot of the second channel member to permit longitudinal movement of the first channel member with reference to the second channel member, a cross-pin normal to said stud, oppositely inclined wedge means adjacent each stud means, means movable into the space between the cross-members and the web of the second channel to forcibly move the projections of the second channel into a state of interference with the projections of the first channel, and lever means connected to spaced wedge means requiring a single movement to simultaneously move the wedges oppositely to clamp the channel members together at a plurality of points.

* * * * *